US010285438B2

(12) United States Patent
Iwata

(10) Patent No.: US 10,285,438 B2
(45) Date of Patent: May 14, 2019

(54) STORAGE CASE FOR STORING HINGE-LIDDED BOX-TYPE PACKAGE

(71) Applicant: JAPAN TOBACCO INC., Tokyo (JP)

(72) Inventor: Shinichi Iwata, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 15/712,994

(22) Filed: Sep. 22, 2017

(65) Prior Publication Data

US 2018/0007956 A1 Jan. 11, 2018

Related U.S. Application Data

(63) Continuation of application No. PCT/JP2015/059201, filed on Mar. 25, 2015.

(51) Int. Cl.
*B65D 85/10* (2006.01)
*A24F 15/12* (2006.01)

(52) U.S. Cl.
CPC ..... *A24F 15/12* (2013.01); *B65D 85/10* (2013.01); *B65D 85/1036* (2013.01)

(58) Field of Classification Search
CPC ..... A24F 15/12; A24F 15/16; B65D 85/10; B65D 85/1036
USPC ..... 206/259
See application file for complete search history.

(56) References Cited

U.S. PATENT DOCUMENTS 2,597,810 A * 5/1952 Myers ..... B65D 5/6688 229/129.1
2,929,542 A * 3/1960 O'Gorman ..... B65D 5/6688 206/268
3,102,675 A * 9/1963 Schrom ..... B65D 5/728 206/250
3,311,283 A * 3/1967 Shimada ..... B65D 5/6688 206/250

(Continued)

FOREIGN PATENT DOCUMENTS

CA 2339426 A1 9/2002
DE 202013010361 U1 11/2013

(Continued)

OTHER PUBLICATIONS

International Search Report, issued in PCT/JP2015/059201 (PCT/ISA/210), dated Jun. 16, 2015.

(Continued)

*Primary Examiner* — Ernesto A Grano
(74) *Attorney, Agent, or Firm* — Birch, Stewart, Kolasch & Birch, LLP

(57) ABSTRACT

A storage case for storing a hinge-lidded box-type package, the hinge-lidded box-type package including a package body that has an open end at an upper part, and is capable of housing an object to be housed therein, and a lid part that is rotatably coupled to an edge of the open end through a hinge, and opens and closes the open end, the storage case having: a bottom surface wall; a rectangular tube wall body that is erected from the bottom surface wall, and forms therein a storage part that stores the package; and an insertion opening (Continued)

that is famed at an upper edge of the rectangular tube wall body, and enables the package to be inserted, wherein a slip-out regulating part that regulates slip-out of the package from the storage part is attached to the insertion opening.

4 Claims, 14 Drawing Sheets

(56) References Cited

U.S. PATENT DOCUMENTS

| | | | | |
|---|---|---|---|---|
| 3,899,125 | A * | 8/1975 | Andrews | B65D 5/6688 206/265 |
| 3,933,299 | A * | 1/1976 | Shimada | B65D 5/6688 229/125.37 |
| 3,977,520 | A * | 8/1976 | Grimm | B65D 85/1054 206/270 |
| 4,646,960 | A * | 3/1987 | Challand | B65D 85/1054 206/259 |
| 7,658,280 | B2 * | 2/2010 | Bardet | B65D 5/6688 206/264 |
| 8,464,867 | B2 * | 6/2013 | Holloway | B65D 85/1054 206/250 |
| 9,687,026 | B2 * | 6/2017 | Clark | A24F 15/12 |
| 2006/0157357 | A1 * | 7/2006 | Serafini | B65D 5/4204 206/268 |
| 2008/0093234 | A1 | 4/2008 | Jones et al. | |
| 2008/0128301 | A1 * | 6/2008 | Bourgoin | B65D 5/38 206/268 |
| 2008/0142578 | A1 * | 6/2008 | Vickerstaff | B65D 5/728 229/125.37 |
| 2008/0289977 | A1 | 11/2008 | Ghini et al. | |
| 2009/0065561 | A1 * | 3/2009 | Bourgoin | B65D 85/1054 229/129.1 |
| 2009/0205982 | A1 * | 8/2009 | Hein | B65D 5/38 206/251 |
| 2011/0062175 | A1 | 3/2011 | Nakamura et al. | |
| 2012/0261285 | A1 | 10/2012 | Holloway et al. | |
| 2012/0261286 | A1 | 10/2012 | Holloway et al. | |
| 2014/0238877 | A1 * | 8/2014 | Petrucci | B65D 85/1054 206/255 |
| 2015/0014404 | A1 * | 1/2015 | Iwata | B65D 5/662 229/160.1 |

FOREIGN PATENT DOCUMENTS

| | | | |
|---|---|---|---|
| EP | 2 305 567 | A1 | 4/2011 |
| EP | 2 594 507 | A1 | 5/2013 |
| GB | 2115386 | A | 9/1983 |
| JP | 7-2282 | U | 1/1995 |
| JP | 2003-135048 | A | 5/2003 |
| JP | 3116461 | U | 12/2005 |
| JP | 3125965 | U | 10/2006 |
| JP | 2006-333713 | A | 12/2006 |
| JP | 2009-507731 | A | 2/2009 |
| JP | 2009-292513 | A | 12/2009 |
| JP | 2009-292516 | A | 12/2009 |
| JP | 2013-511441 | A | 4/2013 |
| TW | 201000369 | A1 | 1/2010 |
| WO | WO 2013/114726 | A1 | 8/2013 |

OTHER PUBLICATIONS

Taiwan Office Action for application No. 104109706 dated Nov. 30, 2016.

English translation of the International Preliminary Report on Patentability and Written Opinion of the International Searching Authority (Forms PCT/IB/338, PCT/IB/373 and PCT/ISA/237) issued in International Application No. PCT/JP2015/059201 dated Oct. 5, 2017.

Japanese Office Action, dated Jun. 19, 2018, for Japanese Application No. 2017-507255, along with an English translation.

Extended European Search Report, dated Nov. 15, 2018, for European Application No. 15886365.4.

* cited by examiner

STORAGE CASE FOR STORING HINGE-LIDDED BOX-TYPE PACKAGE

CROSS-REFERENCE TO RELATED APPLICATIONS

This application is a continuation application of International Application PCT/JP2015/059201 filed on Mar. 25, 2015 and designated the U.S., the entire contents of which are incorporated herein by reference.

TECHNICAL FIELD

The present invention relates to a storage case for storing a hinge-lidded box-type package.

BACKGROUND ART

Conventionally, a hinge-lidded box-type package including a lid part openably coupled to a package body through a hinge is known as a package for housing an object to be housed such as a tobacco product. In this kind of hinge-lidded box-type package, a package body that houses a cigarette bundle, and a lid part for opening and closing an open end formed in an upper part of the package body are generally rotatably coupled to each other through a hinge famed along an edge of the open end.

[Patent document 1] Japanese Patent Laid-Open No. 2003-135048

SUMMARY OF INVENTION

Technical Problem

As described above, the hinge-lidded box-type package adopts a mechanism for rotatably coupling the package body and the lid part through the hinge, and therefore has a problem that the lid part is likely to be unintendedly opened. Therefore, for example, the lid part is unintendedly opened in a bag or a pocket, an object to be housed which is housed in the package body may drop out to the outside. For example, in a case where the hinge-lidded box-type package is used as a cigarette package, the lid part is unintendedly opened, so that cut tobacco for a cigarette may drop out to the outside, or a cigarette may fall off. The present invention has been made in view of the above circumstance, and an object of the present invention is to provide a storage case capable of suppressing unintended opening of a lid part of a hinge-lidded box-type package.

Solution to Problem

In order to solve the above problem, in a storage case for a hinge-lidded box-type package according to the present invention, a slip-out regulating part that regulates slip-out of a package from a storage part is attached to an insertion opening enabling insertion of the package.

More specifically, the present invention is a storage case for storing a hinge-lidded box-type package, the hinge-lidded box-type package including a box-type package body that has an open end at an upper part, and is capable of housing an object to be housed therein, and a lid part that is rotatably coupled to an edge of the open end through a hinge, and opens and closes the open end, the storage case having: a bottom surface wall; a rectangular tube wall body that is erected from the bottom surface wall, and forms therein a storage part that stores the package; and an insertion opening that is famed at an upper edge of the rectangular tube wall body, and enables the package to be inserted from a side of a bottom wall of the package body, wherein a slip-out regulating part that regulates slip-out of the package from the storage part is attached to the insertion opening.

According to the present invention, unintended slip-out of the package from the storage part can be suppressed by the slip-out regulating part attached to the insertion opening of the rectangular tube wall body. Therefore, it is possible to suppress unintended opening of the lid part of the package.

The slip-out regulating part may regulate slip-out of the package from the storage part when the slip-out regulating part is in a projecting posture of projecting toward inside from the rectangular tube wall body such that an effective cross-sectional area of the insertion opening is narrowed, and the slip-out regulating part may allow slip-out of the package from the storage part when the slip-out regulating part is in a flat posture along the rectangular tube wall body such that the effective cross-sectional area of the insertion opening is widened. With such a constitution, it is possible to suitably suppress slip-out of the package housed in the storage part.

The slip-out regulating part may include a pushed part and a locking part connected to each other through a first folding line, and the pushed part may be connected to an edge of the insertion opening through a second folding line, the slip-out regulating part may be shifted from the projecting posture to the flat posture when the pushed part is pushed by the package inserted from the insertion opening, and the slip-out regulating part may be shifted from the flat posture to the projecting posture, and the locking part locks the package when the package is stored in the storage part, and a pushed state of the pushed part is released.

The storage case may further include a sheet member that has a first end side connected to the slip-out regulating part and a second end side inserted into the storage part, and includes an operation part for operating the slip-out regulating part, wherein a window for operation part exposure for exposing the operation part of the sheet member to outside may be formed in the rectangular tube wall body or the bottom surface wall. Consequently, it is possible to access the operation part through the window for operation part exposure, and suitably shift the posture of the slip-out regulating part through the operation part.

The operation part may be a tongue-shaped flap that is formed by a cut provided in the sheet member overlapped so as to close the window for operation part exposure from a side of the storage part, and a position of the cut may be disposed near an edge of the window for operation part exposure. Consequently, when the operation part is pushed through the window for operation part exposure, the operation part is easily fitted to the outer surface of the package. As a result, it is possible to smoothly operate the operation part, and it is possible to easily shift the slip-out regulating part from the projecting posture to the flat posture.

The window for operation part exposure may be formed by folding a second tongue-shaped flap on the side of the storage part, the second tongue-shaped flap being foamed by a cut provided in the rectangular tube wall body, and a slide moving amount of the sheet member may be limited within a predetermined range by engaging the second tongue-shaped flap folded on the side of the storage part with the cut provided in the sheet member that forms the operation part. Consequently, it is possible to suitably suppress forcible shift of the slip-out regulating part from the projecting posture to the flat posture.

A window for package exposure that exposes an outer surface of the package stored in the storage part to outside may be formed in the rectangular tube wall body or the bottom surface wall. According to this structure, it is possible to suitably access the package through the window for package exposure, and suitably use the package.

Means for solving the above problem in the present invention can be combined as much as possible to be adopted.

Advantageous Effects of Invention

According to the present invention, it is possible to provide a storage case capable of suppressing unintended opening of a lid part of a hinge-lidded box-type package.

DESCRIPTION OF EMBODIMENT

Herein, an embodiment of a hinge-lidded box-type package storage case according to the present invention will be described with reference to the drawings. The size, materials, shapes, and relative placement and the like of components described in this embodiment are not intended to limit the scope of the invention thereto, unless otherwise stated.

<Embodiment 1>

Figure 1:
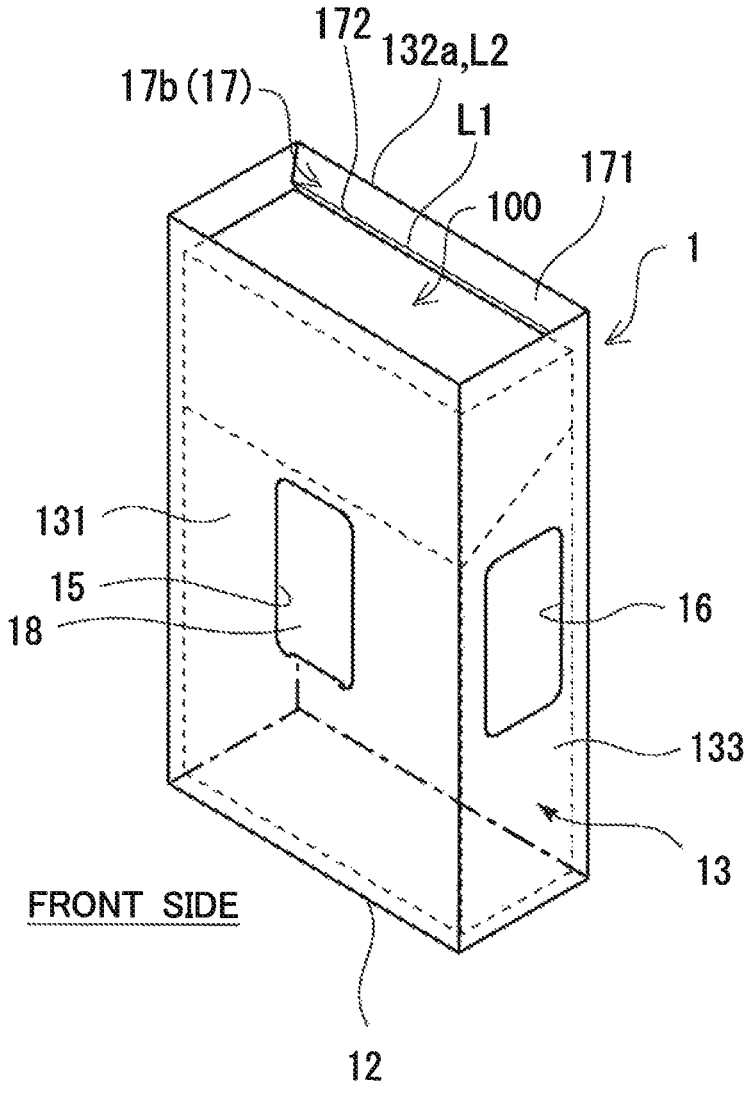
FIG. 1 is a perspective view of a storage case according to Embodiment 1.
Figure 2:
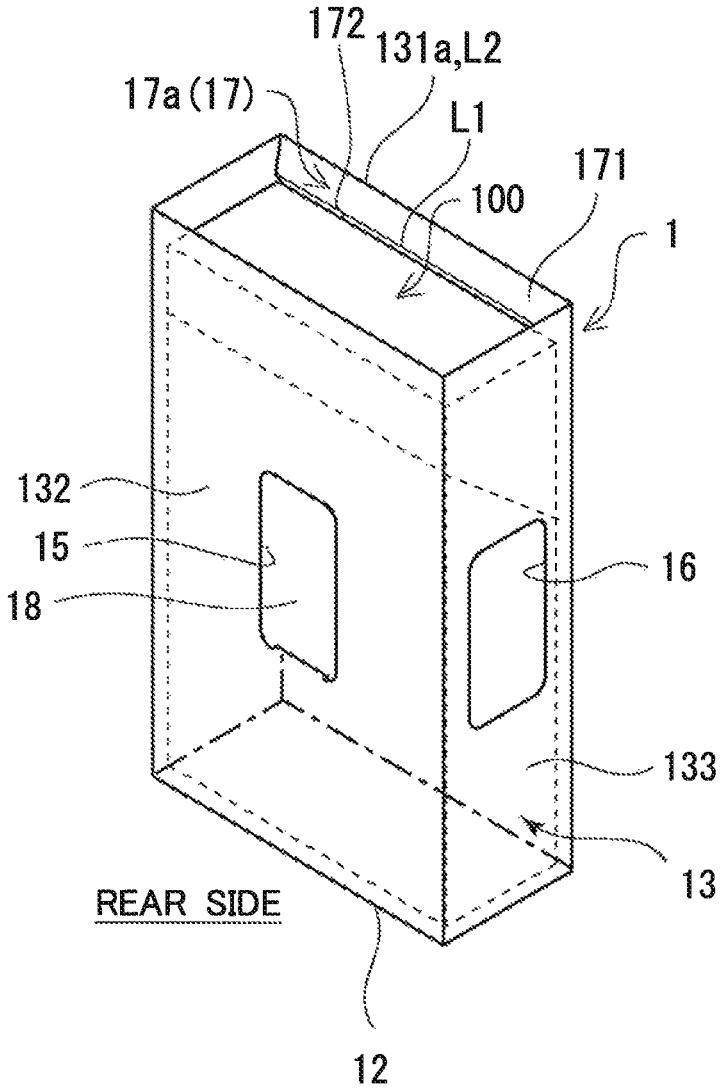
FIG. 2 is a perspective view of the storage case according to Embodiment 1.

FIG. 1 and FIG. 2 each are a perspective view of a storage case 1 according to Embodiment 1. The storage case 1 is a case that stores a hinge-lidded box-type package (hereinafter, simply referred to as a "package") 100. A storage part that stores the package 100 is formed inside the storage case 1, and FIG. 1 and FIG. 2 each illustrate a state where the package 100 is stored in the storage part of the storage case 1. The storage case 1 according to this embodiment is formed by folding a blank having a folding line (ruled line) at a right place along the folding line to assemble the blank. As the blank, for example, plastic or other materials may be used in addition to a paper material such as a card-board and a manila lined board.

Figure 3:
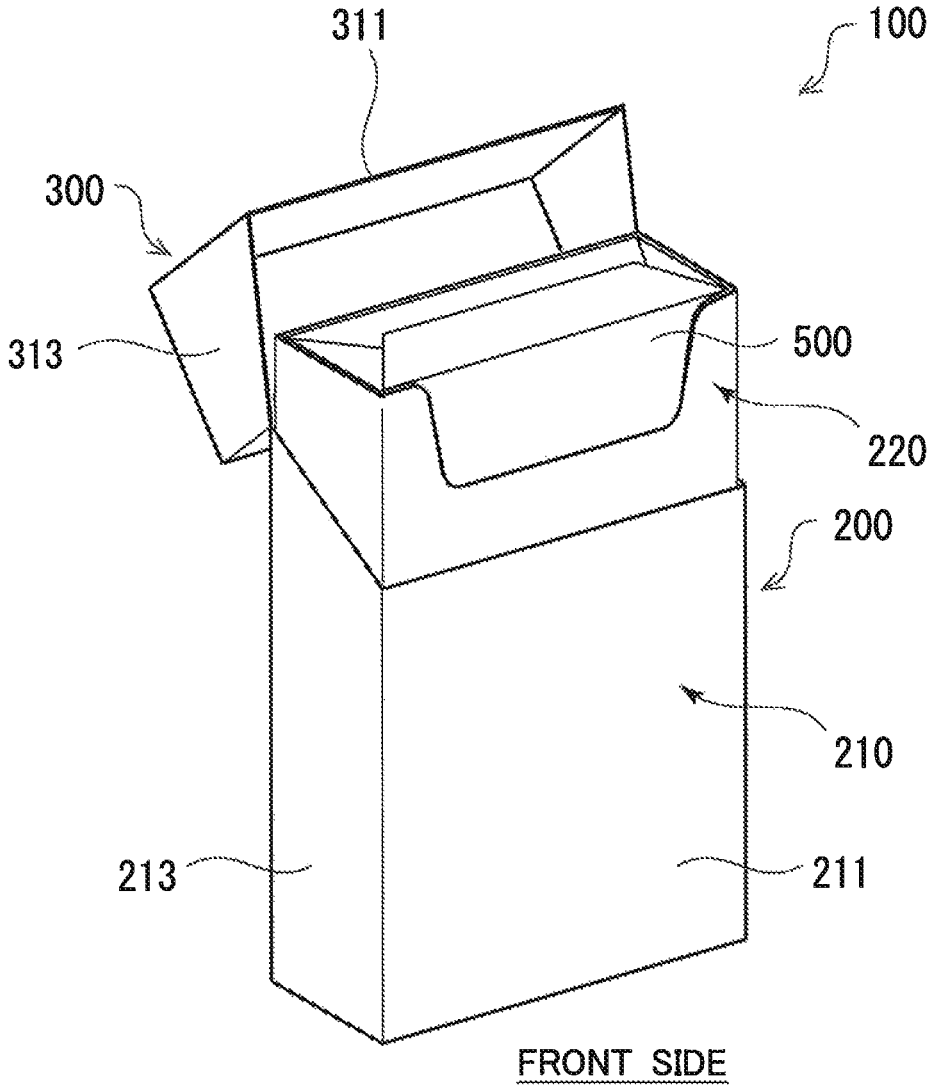
FIG. 3 is a view illustrating a package according to Embodiment 1.
Figure 4:
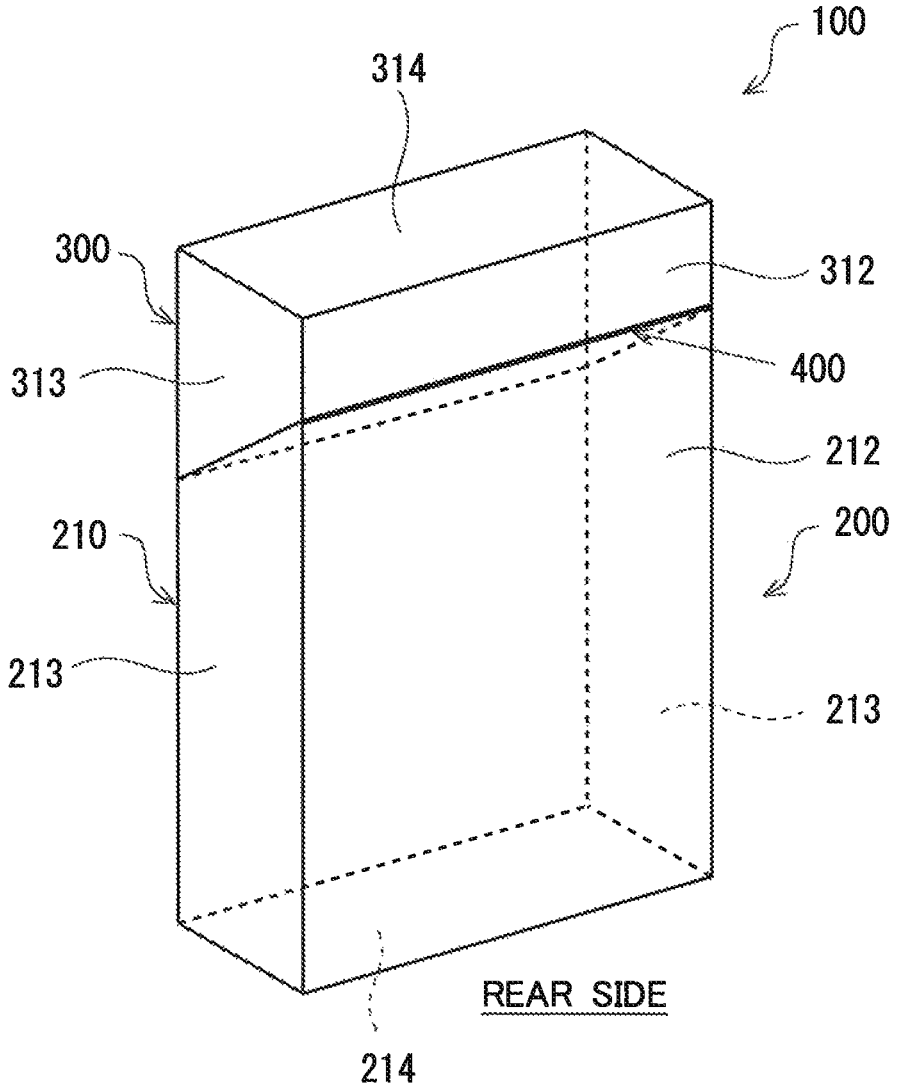
FIG. 4 is a view illustrating the package according to Embodiment 1.

FIG. 3 and FIG. 4 each are a view illustrating the package 100 according to Embodiment 1. The package 100 is a so-called substantially rectangular parallelepiped hinge-lidded box-type package. The package 100 includes a package body 200, and a lid part 300 rotatably coupled to the package body 200 through a hinge. This lid part 300 is sometimes referred to as a "lid".

FIG. 3 illustrates the package 100 with the lid part 300 opened as viewed from a front side. FIG. 4 is a perspective view of the package 100 with the lid part 300 closed as viewed from a rear side. The package body 200 includes an outer box 210 that is a box body having a shape in which a rectangular parallelepiped upper end side is obliquely cut out, and an inner frame 220 provided on an open end of the outer box 210. The outer box 210 of the package body 200 has a front wall 211, a rear wall 212, a pair of side walls 213, and a bottom wall 214.

The inner frame 220 is a member having a substantially U-shaped front surface frame, and side surface frames coupled to both side edges of this front surface frame, and is adhered to an inner surface of the outer box 210 while partially protruding upward from the open end of the outer box 210. The inner frame 220 reinforces the open end of the outer box 210, and functions as a guide for guiding opening and closing of the lid part 300.

The lid part 300 has a front wall 311, a rear wall 312, a pair of side walls 313, and a top wall 314. An upper end of the rear wall 212 of the outer box 210 and a lower end of the rear wall 312 of the lid part 300 are coupled to each other through a hinge 400, and the lid part 300 and the outer box 210 are rotatable around this hinge 400.

A housing space for housing an object to be housed is formed inside the package body 200, and in this embodiment, an inner pack 500 illustrated in FIG. 3 is housed. The inner pack 500 is a bundle of cigarettes wrapped by, for example, an inner packing material made of aluminum vapor-deposited paper on which aluminum is deposited. However, an object to be housed which is housed in the package body 200 is not particularly limited.

Now, a detailed structure of the storage case 1 will be described. FIG. 1 illustrates the storage case 1 viewed from the right oblique front side. FIG. 2 illustrates the storage case 1 viewed from the left oblique rear side. The storage case 1 according to this embodiment is a bottomed rectangular tube-like case capable of storing the above package 100. More specifically, the storage case 1 has a bottom surface wall 12, and a rectangular tube wall body 13 erected from this bottom surface wall 12, and forming the storage part that stores the package 100 therein.

The bottom surface wall 12 of the storage case 1 has a rectangular shape whose size is substantially the same as the bottom wall 214 of the package body 200 (outer box 210) and the top wall 314 of the lid part 300 in the package 100. Additionally, the rectangular tube wall body 13 of the storage case 1 is composed of a front surface wall 131, a rear surface wall 132, a left side surface wall 133*a*, and a right side surface wall 133*b*. Herein, the front surface wall 131 and the rear surface wall 132 in the rectangular tube wall body 13 are formed with respective windows 15 for operation part exposure. The one window 15 for operation part exposure is provided in each of the front surface wall 131 and the rear surface wall 132. In the example illustrated in FIG. 1 and FIG. 2, the respective substantially rectangular windows 15 for operation part exposure are provided near central parts of the front surface wall 131 and the rear surface wall 132 in the rectangular tube wall body 13. Upper edges, lower edges, and pairs of side edges surrounding the windows 15 for operation part exposure are disposed in parallel to upper edges, lower edges, and pairs of side edges of the front surface wall 131 and the rear surface wall 132.

Furthermore, the left side surface wall 133*a* and the right side surface wall 133*b* in the rectangular tube wall body 13 are formed with respective windows 16 for package exposure. In the example illustrated in FIG. 1 and FIG. 2, the respective substantially rectangular windows 16 for package exposure are provided near central parts of the left side surface wall 133*a* and the right side surface wall 133*b* in the rectangular tube wall body 13. Upper edges, lower edges, and pairs of side edges surrounding the windows 16 for package exposure are disposed in parallel to upper edges, lower edges, and pairs of side edges of the left side surface wall 133*a* and the right side surface wall 133*b*. While details of the windows 15 for operation part exposure and the windows 16 for package exposure will be described below, the windows 15 for operation part exposure each are an opening window for exposing an operation part for operating a below-described slip-out regulating part 17 to the outside so as to enable access. Additionally, the windows 16 for package exposure each are an opening window for exposing an outer surface of the package 100 being stored in the storage part 14 to the outside so as to enable access.

Figure 5:
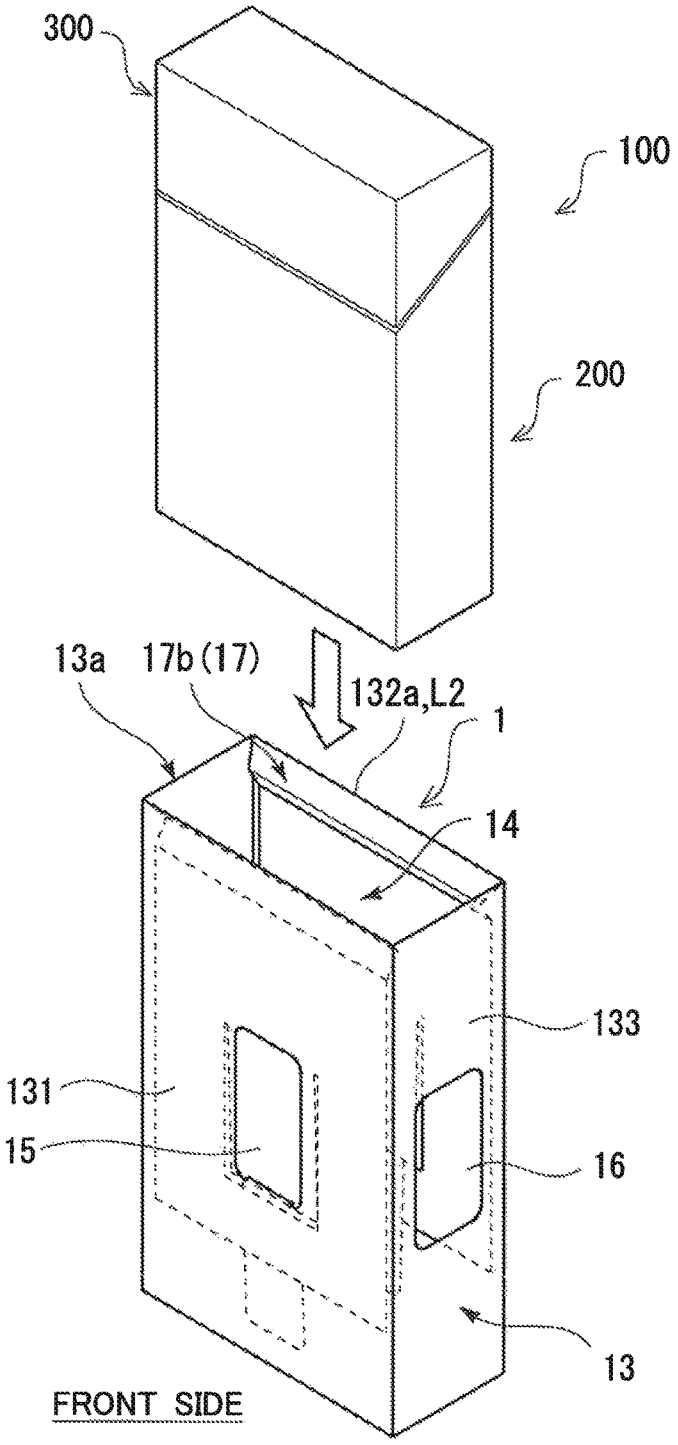
FIG. 5 is a view illustrating the storage case in a state before the package according to Embodiment 1 is stored.
Figure 6:
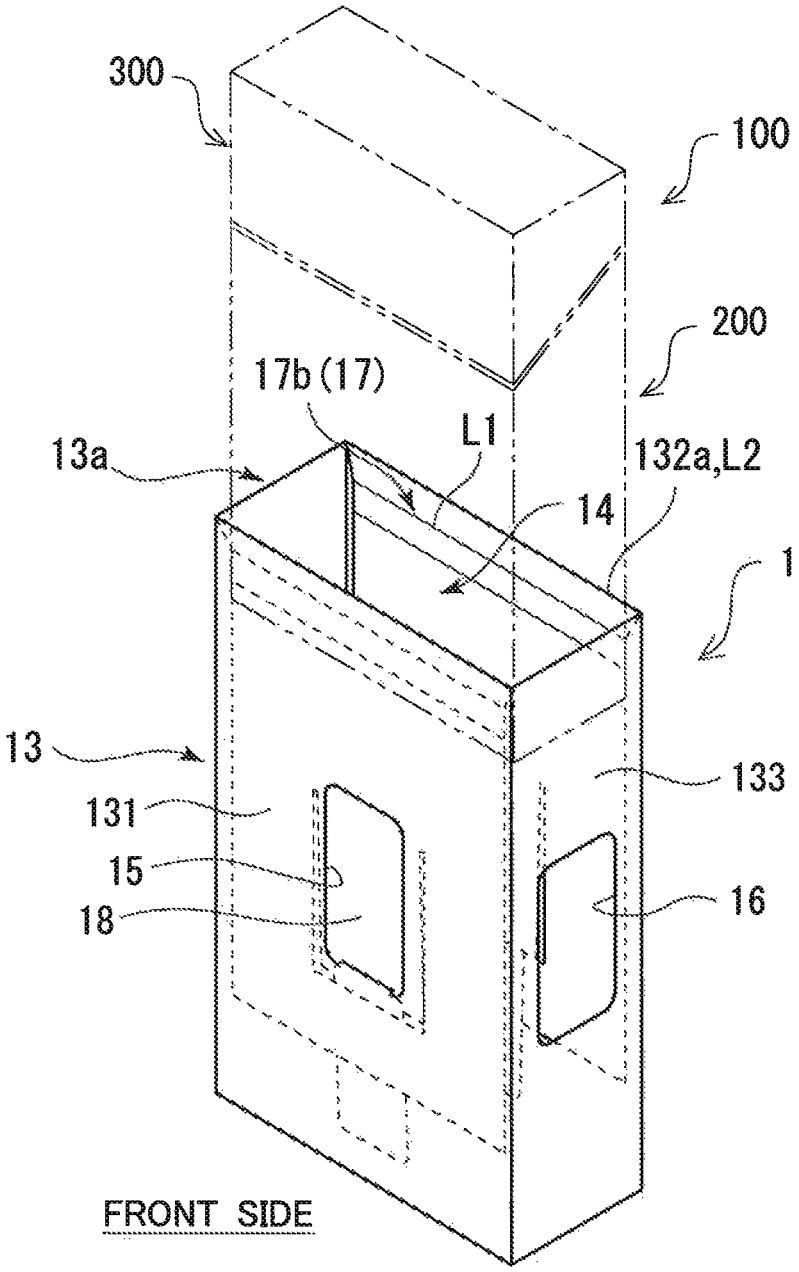
FIG. 6 is a view illustrating a storage case in a state where the package according to Embodiment 1 is in a storing process.

FIG. 5 illustrates a view illustrating the storage case 1 in a state before the package 100 according to Embodiment 1 is stored. FIG. 6 is a view illustrating the storage case 1 in a state where the package 100 according to Embodiment 1 is in a storing process (in the middle of storage). In FIG. 6, an external foam of the package 100 is illustrated by a two-dot chain line. Inside the storage case 1 surrounded by the bottom surface wall 12 and the rectangular tube wall body 13, the storage part 14 that is a storage space for storing the package 100 is formed. An upper end of the rectangular tube wall body 13 in the storage case 1 is an open end, and this open end is formed as an insertion opening 13*a* for enabling the package 100 to be inserted into the storage part 14 from the bottom wall 214 side of the package body 200 (outer box 210).

Herein, the width dimensions of the front surface wall 131 and the rear surface wall 132 of the rectangular tube wall body 13 are equal to each other, and each are equal to or slightly larger than the width dimension of the package 100. Additionally, the width dimensions of the left side surface wall 133*a* and the right side surface wall 133*b* of the rectangular tube wall body 13 are equal to each other, and each are equal to or slightly larger than the depth dimension of the package 100.

Hereinafter, in the rectangular tube wall body 13, the direction along the normal direction of the bottom surface wall 12 is defined as the "height direction". In a plane of the front surface wall 131, the rear surface wall 132, the left side surface wall 133*a*, and the right side surface wall 133*b*, the direction perpendicular to the height direction is defined as the "width direction". The height dimension of the rectangular tube wall body 13 is called the "case height dimension". The "case height dimension" is equivalent to the separated dimension of the insertion opening 13*a* of the rectangular tube wall body 13 from the bottom surface wall 12. In this embodiment, the case height dimension of the storage case 1 is set to be larger than the height dimension (hereinafter, also referred to as the "package height dimension") of the package 100. The height dimension of the package 100 is the separated dimension of the top wall 314 of the lid part 300 from the bottom wall 214 of the package body 200 (outer box 210) in a state where the lid part 300 of the package 100 is closed.

Figure 7:
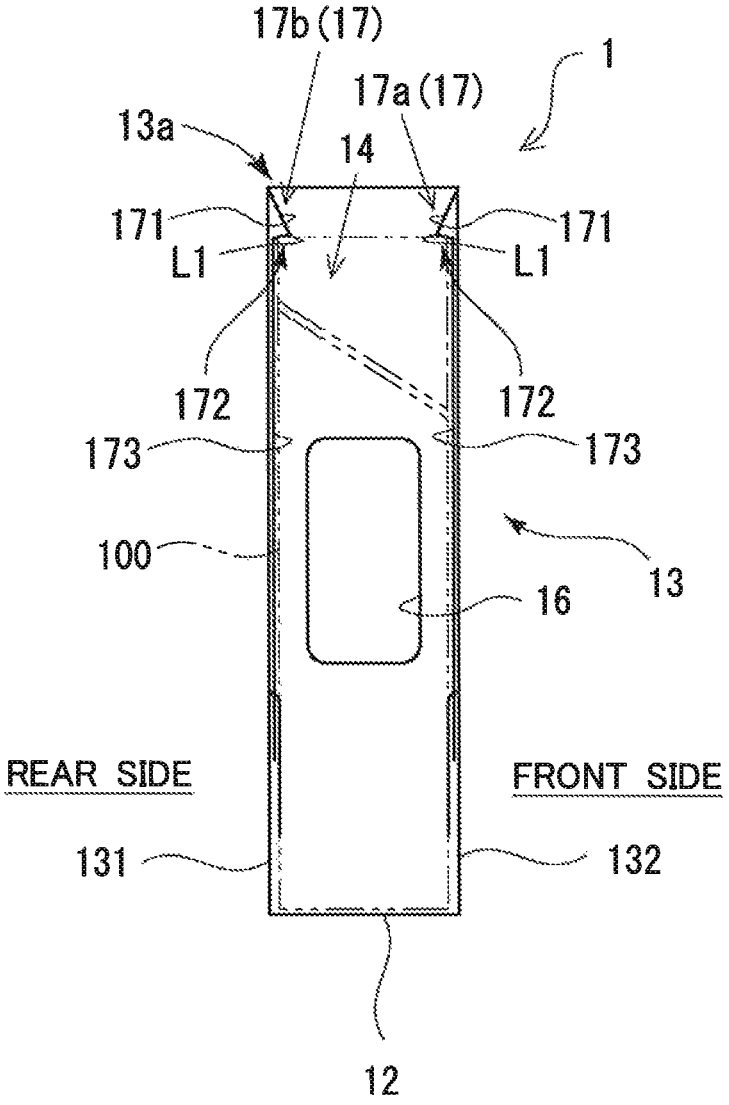
FIG. 7 is a longitudinal sectional view of the storage case in the state where the package according to Embodiment 1 is stored.
Figure 8:
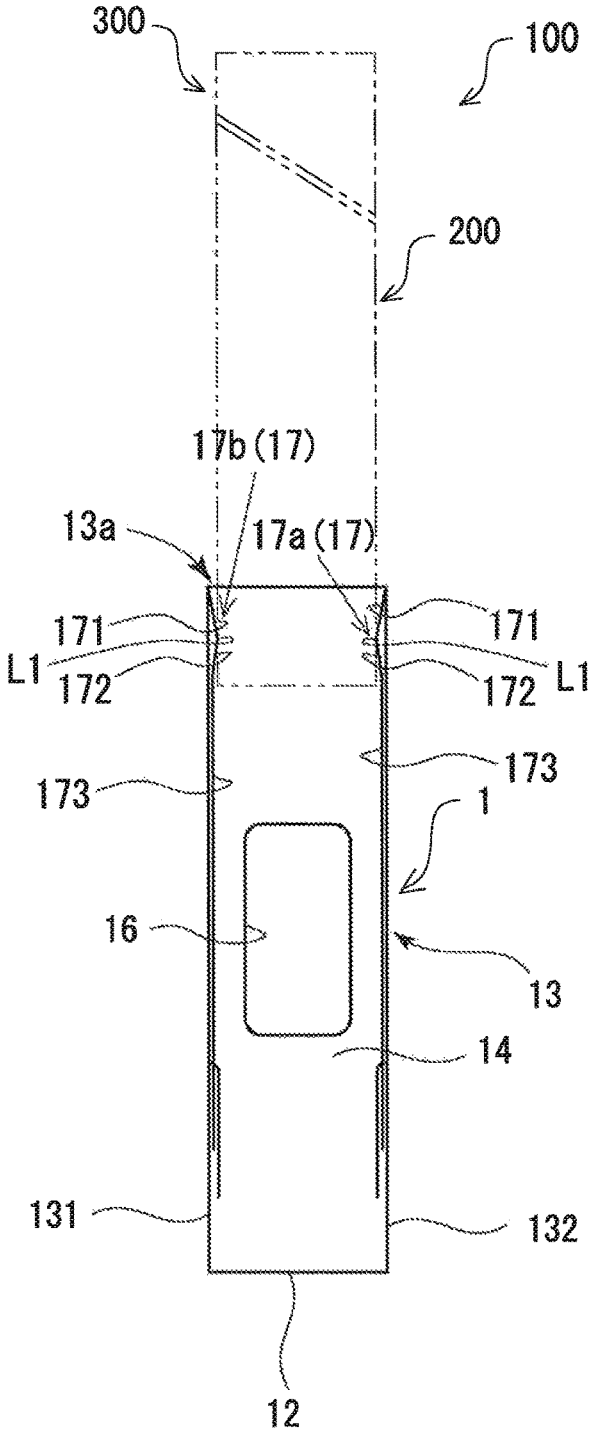
FIG. 8 is a longitudinal sectional view of the storage case in a state where the package according to Embodiment 1 is in the storing process.
Figure 9:
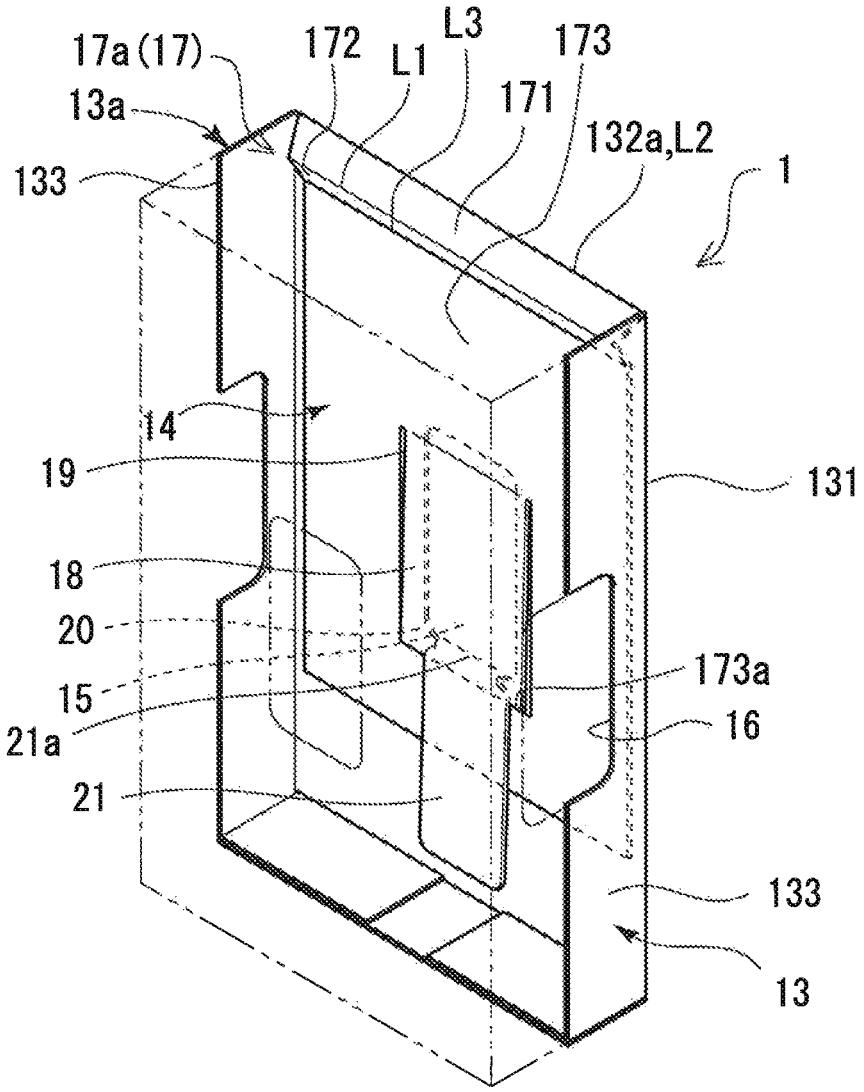
FIG. 9 is an exploded view for illustrating an internal structure of the storage case according to Embodiment 1.

Now, the slip-out regulating part of the storage case 1 will be described. FIG. 7 is a longitudinal sectional view of the storage case 1 in a state illustrated in FIG. 1, namely, in a state where the package 100 is stored in the storage part 14. In FIG. 7, the external form of the package 100 is illustrated by a two-dot chain line. FIG. 8 is a longitudinal sectional view of the storage case 1 in a state illustrated in FIG. 6, namely, in a state where the package 100 is in a process of being stored in the storage part 14. FIG. 7 and FIG. 8 each illustrate a cross-section of the storage case 1 taken along a cut section parallel to the left side surface wall 133*a* and the right side surface wall 133*b* of the rectangular tube wall body 13. FIG. 9 is an exploded view for illustrating an internal structure of the storage case 1 according to Embodiment 1. FIG. 9 illustrates the internal structure of the storage case 1 on the front surface wall 131 side. An internal structure of the storage case 1 on the rear surface wall 132 side is the same as the internal structure on the front surface wall 131 side, illustrated in FIG. 9.

The storage case 1 according to this embodiment includes slip-out regulating parts 17 that suppress unintended slip-out of the package 100 stored in the storage part 14 from the storage part 14. The slip-out regulating parts 17 are attached to the insertion opening 13*a* of the rectangular tube wall body 13. More specifically, a first slip-out regulating part 17*a* and a second slip-out regulating part 17*b* are provided along a pair of long sides in the insertion opening 13*a* of the rectangular tube wall body 13, namely along the upper edge 131*a* of the front surface wall 131 and the upper edge 132*a* of the rear surface wall 132. Hereinafter, in a case where the first slip-out regulating part 17*a* and the second slip-out regulating part 17*b* are collectively called "slip-out regulating parts 17".

The slip-out regulating parts 17 (the first slip-out regulating part 17*a*, the second slip-out regulating part 17*b*) each are composed of a trapezoidal pushed part 171 and a rectangular locking part 172 connected to each other through a first folding line L1. In the pushed part 171 of the first slip-out regulating part 17*a*, a side corresponding to a base line of the trapezoid is connected to the upper edge 131*a* of the front surface wall 131 through a second folding line L2. Similarly, in the pushed part 171 of the second slip-out regulating part 17*b*, one of bottom lines of the trapezoid is connected to the upper edge 132*a* of the rear surface wall 132 through the second folding line L2. The pushed part 171 of the first slip-out regulating part 17*a* is connected to the upper edge 131*a* through the second folding line L2 over the whole width of the front surface wall 131. Similarly, the pushed part 171 of the second slip-out regulating part 17*b* is connected to the upper edge 132*a* through the second folding line L2 over the whole width of the rear surface wall 132. Additionally, in each of the slip-out regulating parts 17 (the first slip-out regulating part 17*a*, the second slip-out regulating part 17*b*) in this embodiment, the first folding line L1 is shorter than the second folding line L2. That is, the pushed part 171 has the trapezoid in which a side on the first folding line L1 side is shorter than a side on the second folding line L2 side.

The other bottom line of the pushed part 171 is connected to one of long sides of the locking part 172 through the first folding line L1. A first end side of a rectangular sheet-like sheet member 173 is connected to the other long side of the locking part 172 through a third folding line L3, and a second end side of the sheet member 173 is inserted into the storage part 14. The sheet member 173 of the first slip-out regulating part 17*a* is disposed along an inner surface of the front surface wall 131 of the rectangular tube wall body 13, and extends toward the bottom surface wall 12. Additionally, the sheet member 173 of the second slip-out regulating part 17*b* is disposed along an inner surface of the rear surface wall 132 of the rectangular tube wall body 13, and extends toward the bottom surface wall 12.

In this embodiment, the first folding line L1 to the third folding line L3 in each of the slip-out regulating parts 17 are in a mutually parallel relation. In each slip-out regulating part 17, the pushed part 171 is rotated relative to the front surface wall 131 (rear surface wall 132) around the second folding line L2, so that it is possible to change an angle famed by the front surface wall 131 (rear surface wall 132) and the pushed part 171. The pushed part 171 and the locking part 172 are relatively rotated around the first folding line L1, so that it is possible to change an angle famed by the pushed part 171 and the locking part 172. The locking part 172 and the sheet member 173 are relatively rotated around the third folding line L3, so that it is possible to change an angle famed by the locking part 172 and the sheet member 173.

As illustrated in FIG. 9, the sheet-like rectangular sheet member 173 whose width is slightly narrower than the width dimension of the front surface wall 131 (rear surface wall 132) of the rectangular tube wall body 13 is coupled to the locking part 172 of each of the slip-out regulating parts 17 (the first slip-out regulating part 17*a*, the second slip-out regulating part 17*b*) through the third folding line L3. Thus, the sheet member 173 that extends from the slip-out regulating parts 17 attached to the upper edge 131*a* (132*a*) of the front surface wall 131 (rear surface wall 132) of the rectangular tube wall body 13 is inserted into the storage part 14 from the insertion opening 13*a*, and is disposed so as to face the inner surface of the front surface wall 131 (rear surface wall 132). The sheet member 173 is overlapped so as to close the window 15 for operation part exposure of the front surface wall 131 (rear surface wall 132) from the storage part 14 side of the storage case 1.

Now, a detailed structure of each sheet member 173 will be described. The sheet member 173 includes an operation part 18 for operating the slip-out regulating part 17 in a part thereof. The operation part 18 is formed as a tongue-shaped flap formed by a three-side cut (slit) 19 formed in the sheet member 173. The operation part 18 in the sheet member 173 is disposed so as to overlap with the window 15 for operation part exposure provided in the front surface wall 131 (rear surface wall 132). Consequently, the operation part 18 disposed in the storage part 14 is exposed to the outside so as to enable access through the window 15 for operation part exposure. More specifically, the three-side cut 19 is disposed near the edges of the window 15 for operation part exposure, more specifically, the pair of side edges, and the lower edge, along these edges. More specifically, a position of the three-side cut 19 is disposed at a position slightly outside the side edges and the lower edge of the window 15 for operation part exposure in the front surface wall 131 (rear surface wall 132) along these edges.

Herein, the window 15 for operation part exposure famed in the front surface wall 131 (rear surface wall 132), of the rectangular tube wall body 13 is formed by folding a second tongue-shaped flap 21 formed by a three-side cut 20 provided in the front surface wall 131 (rear surface wall 132), on the storage part 14 side. Herein, the three-side cuts 19 in the sheet member 173 is disposed at a position slightly outside the side edges and the lower edge of the window 15 for operation part exposure in the front surface wall 131 (rear surface wall 132), namely, slightly outside positions where the three-side cuts 20 are formed. In this embodiment, the relative relation between the three-side cut 19 in the sheet member 173 and the window 15 for operation part exposure (three-side cuts 20) are defined as described above, and therefore the second tongue-shaped flap 21 folded on the storage part 14 side can be easily inserted into the three-side cut 19 in the sheet member 173. That is, as illustrated in FIG. 9, the second tongue-shaped flap 21 folded on the storage part 14 side can be engaged with a lower edge of the cut 19 provided on the sheet member 173 side foaming the operation part 18. Consequently, a slide moving amount of the sheet member 173 can be limited within a predetermined range.

In the storage case 1 thus famed, each slip-out regulating part 17 can be shifted between a projecting posture for regulating slip-out of the package 100 being in a storage state from the storage part 14, and a flat posture for allowing slip-out of the package 100 from the storage part 14.

As illustrated in FIG. 1, FIG. 2, FIG. 5, FIG. 7, FIG. 9 and the like, the pushed part 171 and the locking part 172 are largely bent relatively with the first folding line L1 as a boundary, and the projecting posture of the slip-out regulating part 17 in the storage case 1 is a posture in which the slip-out regulating part 17 composed of the pushed part 171 and the locking part 172 becomes projection (triangle, chevron). In this projecting posture, the slip-out regulating part 17 projects toward the inside of the rectangular tube wall body 13 with respect to the front surface wall 131 (rear surface wall 132) of the rectangular tube wall body 13, and the effective cross-sectional area of the insertion opening 13*a* is narrowed.

In this embodiment, when the pushed part 171 of the slip-out regulating part 17 is not pushed from the above, or pushing-down operation of the operation part 18 is not performed, the slip-out regulating part 17 becomes in the projecting posture by repulsive force of a raw material, namely, repulsive force between the pushed part 171 and the locking part 172 folded with the first folding line L1 as the boundary. As described above, the case height dimension of the storage case 1 is set to be larger than the package height dimension, and as illustrated in FIG. 7, in the state where the package 100 is stored in the storage part 14 of the storage case 1, the height of a top of the locking part 172 is adjusted to be equal to or slightly higher than the height of the package 100.

As a result, in the state where the package 100 is stored in the storage part 14, the locking part 172 of the slip-out regulating parts 17 locks the top of the package 100, and slip-out of the package 100 from the storage part 14 is regulated. In a case where the package is inserted into the insertion opening 13*a* of the storage case 1 from the bottom wall 214 of the package 100 (package body 200), and the bottom wall 214 of the package 100 faces the bottom surface wall 12 of the storage case 1 as illustrated in FIG. 7, the top wall 314 of the lid part 300 is equivalent to the top of the package 100, and the top wall 314 locks the locking part 172, so that the slip out of the package 100 is prohibited. On the other hand, in a case where the package is inserted into the insertion opening 13*a* of the storage case 1 from the top wall 314 of the package 100 (lid part 300), the bottom wall 214 of the package body 200 is equivalent to the top of the package 100, and the bottom wall 214 locks the locking part 172, so that the slip out of the package 100 is prohibited.

On the other hand, when the slip-out regulating parts 17 in the storage case 1 are each in the flat posture, as illustrated in FIG. 6 and FIG. 8, the angle formed by the pushed part 171 and the locking part 172 is relatively wider than the angle in the projecting posture state, and the slip-out regulating part 17 becomes in a flat posture as a whole. That is, in the flat posture, the slip-out regulating part 17 is along the front surface wall 131 (rear surface wall 132) of the rectangular tube wall body 13, so that the effective cross-sectional area of the insertion opening 13*a* is relatively wider than the effective cross-sectional area of the insertion opening 13*a* in the state of the projecting posture. As a result, when the slip-out regulating part 17 is in the flat posture, slip-out of the package 100 from the storage part 14 is allowed.

Figure 11:
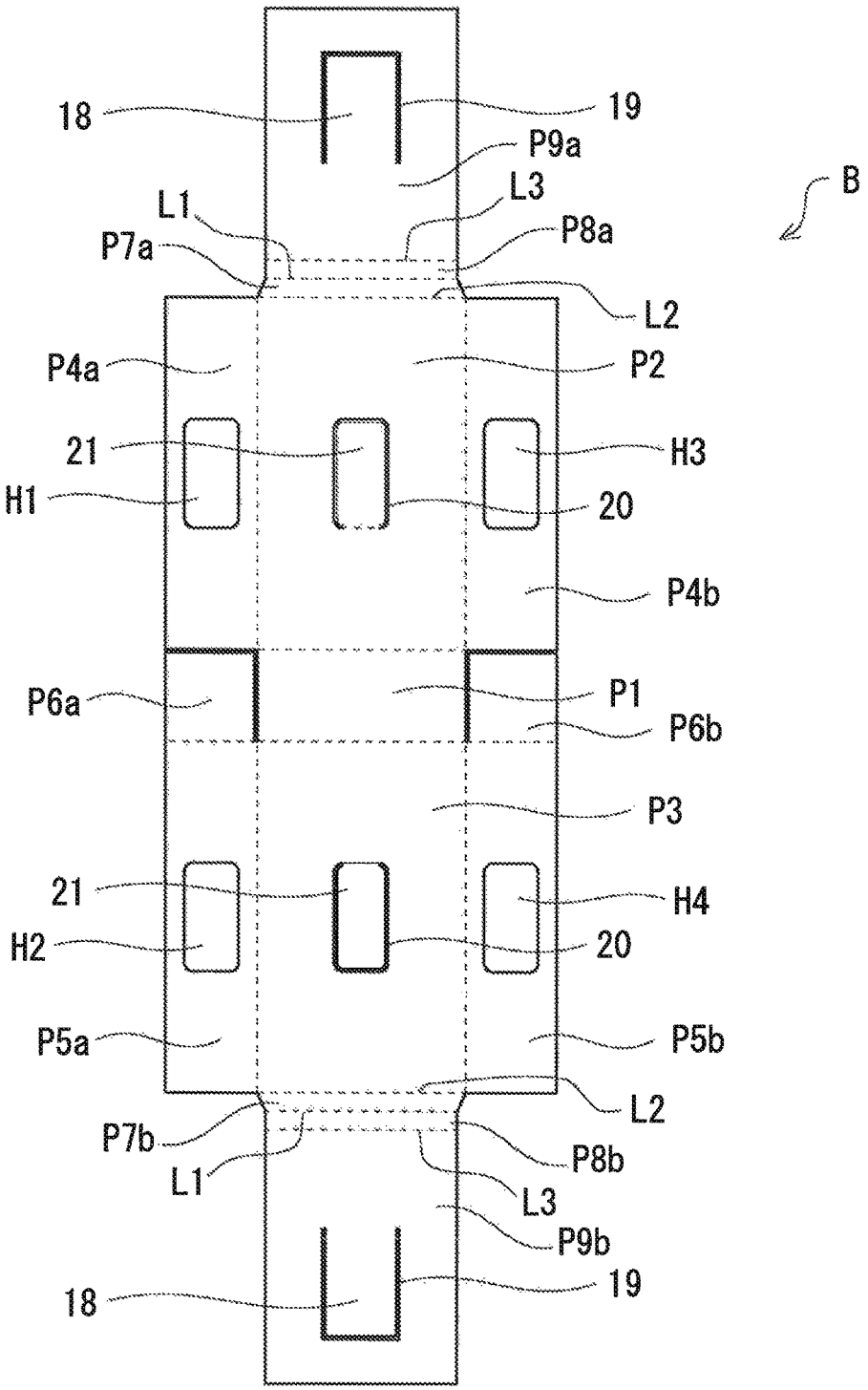
FIG. 11 is a view illustrating a blank forming the storage case according to Embodiment 1.

FIG. 11 is a view illustrating a blank B for forming the storage case 1 according to the embodiment. The blank B is a plate paper material in an exploded state before folded into a box type as the storage case 1. Broken lines illustrated in FIG. 11 illustrate folding lines (ruled lines), and the blank B is folded in along these folding lines (ruled lines), and the right places are adhered, so that the storage case 1 is famed.

The blank B has a bottom surface panel P1 that becomes the bottom surface wall 12 of the storage case 1, and a front surface panel P2 that becomes the front surface wall 131 of the rectangular tube wall body 13, and a rear surface panel P3 that becomes the rear surface wall 132 are continued to this bottom surface panel P1 through the folding lines. A left side surface panel P4*a* that becomes the left side surface wall 133*a*, and a right side surface panel P4*b* that becomes the right side surface wall 133*b* are continued to the front surface panel P2 through the folding lines. Additionally, a left side surface reinforcing panel P5*a* that forms the left side surface wall 133*a* together with the left side surface panel P4*a*, and a right side surface reinforcing panel P5*b* that forms the right side surface wall 133*b* together with the right side surface panel P4*b* are continued to the rear surface panel P3 through the folding lines. When the blank B is assembled, the left side surface reinforcing panel P5*a* and the right side surface reinforcing panel P5*b* are bonded to the left side surface panel P4*a* and the right side surface panel P4*b*, respectively. Additionally, bottom surface reinforcing flaps P6*a*, P6*b* bonded to the bottom surface panel P1 are continued to the left side surface reinforcing panel P5*a* and the right side surface reinforcing panel P5*b* of the blank B through the folding lines, respectively.

The respective three-side cuts 20 that become the windows 15 for operation part exposure are famed in the front surface panel P2 and the rear surface panel P3 of the blank B. When the blank B is assembled, the second tongue-shaped flaps 21 formed by the three-side cuts 20 in the front surface panel P2 and the rear surface panel P3 are folded back, so that the windows 15 for operation part exposure are famed (refer to FIG. 9).

In the left side surface panel P4*a*, the right side surface panel P4*b*, the left side surface reinforcing panel P5*a*, and the right side surface reinforcing panel P5*b* of the blank B, cutout holes H1 to H4 that become the windows 16 for package exposure are foamed. The cutout holes H1 to H4 have the same shape and the same size. At the time of assembling of the blank B, when the left side surface reinforcing panel P5*a* is bonded to the left side surface panel P4*a*, the cutout holes H1 and H2 are overlapped with each other, so that the window 16 for package exposure of the left side surface wall 133*a* is formed. Similarly, when the right side surface reinforcing panel P5*b* is bonded to the right side surface panel P4*b*, the cutout holes H3 and H4 are overlapped with each other, so that the window 16 for package exposure of the right side surface wall 133*b* is formed.

Furthermore, a first pushed panel P7*a* that becomes the pushed part 171 of the first slip-out regulating part 17*a* is continued to the front surface panel P2 of the blank B through the second folding line L2. Additionally, a first locking panel P8*a* that becomes the locking part 172 of the first slip-out regulating part 17*a* is continued to the first pushed panel P7*a* of the blank B through the first folding line L1. Additionally, a second pushed panel P7*b* that becomes the pushed part 171 of the second slip-out regulating part 17*b* is continued to the rear surface panel P3 of the blank B through the second folding line L2. A second locking panel P8*b* that becomes the locking part 172 of the second slip-out regulating part 17*b* is continued to the second pushed panel P7*b* through the first folding line L1.

A first sheet member panel P9*a* and a second sheet member panel P9*b* that become the sheet members 173 are continued to the first locking panel P8*a* and the second locking panel P8*b* of the blank B through the third folding lines L3, respectively. The respective three-side cuts 19 are provided in the first sheet member panel P9*a* and the second sheet member panel P9*b*, and the operation parts 18 are formed as the tongue-shaped flaps by the three-side cuts 19.

The blank B thus famed is folded with the folding lines as boundaries, and the right places are bonded, so that the blank B is assembled as the storage case 1. At this time, as described above, the left side surface reinforcing panel P5*a* and the right side surface reinforcing panel P5*b* are bonded to the left side surface panel P4*a* and the right side surface panel P4*b*, respectively. Additionally, the bottom surface reinforcing flaps P6*a*, P6*b* are bonded to the bottom surface panel Pl. The first pushed panel P7*a*, the first locking panel P8*a*, and the first sheet member panel P9*a* sequentially continued to from the front surface panel P2 are folded back to the inside with the second folding line L2 as the boundary. Additionally, the second pushed panel P7*b*, the second locking panel P8*b*, and the second sheet member panel P9*b* sequentially continued from the rear surface panel P3 are folded back to the inside with the second folding line L2 as the boundary. Then, the respective second tongue-shaped flaps 21 in the front surface panel P2 and the rear surface panel P3 are folded back to the inside are inserted through the lower edges of the cuts 19 famed in the first sheet member panel P9*a* and the second sheet member panel P9*b* to be engaged with the lower edges. Consequently, assembling of the storage case 1 is completed.

Now, operation when the package 100 is stored in the storage case 1 will be described. As illustrated in FIG. 5, FIG. 9 and the like, in a state before the package 100 is stored, the slip-out regulating parts 17 of the storage case 1 are each maintained in the projecting posture. As illustrated in FIG. 8, when the package 100 is inserted from the insertion opening 13*a* of the storage case 1 from this state, the bottom wall 214 (top wall 314 in a case of the reverse direction) of the package 100 collides with the pushed parts 171 of the slip-out regulating parts 17 in the projecting posture, and pushes the pushed parts 171. Then, the pushed parts 171 and the locking parts 172 relatively rotate around the first folding lines L1 in such directions such that the angles formed by the pushed parts 171 and the locking parts 172 expand, the slip-out regulating parts 17 each become in a flat posture as a whole. That is, the pushed parts 171 of the slip-out regulating parts 17 are pushed to be widened by the bottom wall 214 (top wall 314) of the package 100, and the slip-out regulating parts 17 are each shifted from the projecting posture to the flat posture.

As a result, the effective cross-sectional area of the insertion opening 13*a* is secured, and the package 100 can be inserted into the storage part 14 of the storage case 1 as illustrated in FIG. 8. In the storage case 1 according to this embodiment, as described above, the pushed part 171 of the slip-out regulating parts 17 (the first slip-out regulating part 17*a*, the second slip-out regulating part 17*b*) each have a trapezoidal in which the side on the first folding line L1 side is shorter than the side on the second folding line L2 side. Therefore, the width dimensions of the pushed parts 171, the locking parts 172, and the sheet members 173 are slightly smaller than the width dimension of the rectangular tube wall body 13. Consequently, it is possible to avoid contact of ends of the pushed parts 171, the locking parts 172, the sheet members 173 and the like with an inner wall surface of the rectangular tube wall body 13 (specifically, inner surfaces of the left side surface wall 133*a* and the right side surface wall 133*b*), when the package 100 is inserted from the insertion opening 13*a* of the storage case 1 and the postures of the slip-out regulating parts 17 are shifted from the projecting postures to the flat postures. As a result, it is possible to suppress hindering of smooth shift of the slip-out regulating parts 17 from the projecting postures to the flat postures.

As illustrated in FIG. 7, when the bottom wall 214 (top wall 314) of the package 100 reaches the bottom surface wall 12 of the storage case 1, and the package 100 is completely stored in the storage part, the pushed states of the pushed parts 171 in the slip-out regulating parts 17 by the package 100 are released. As a result, as illustrated in FIG. 7, the slip-out regulating parts 17 automatically return from the flat postures to the projecting postures by repulsive force between the pushed parts 171 and the locking parts 172 folded with the first folding lines L1 as the boundaries, and the package 100 is locked by the locking parts 172 of the slip-out regulating parts 17.

Figure 10:
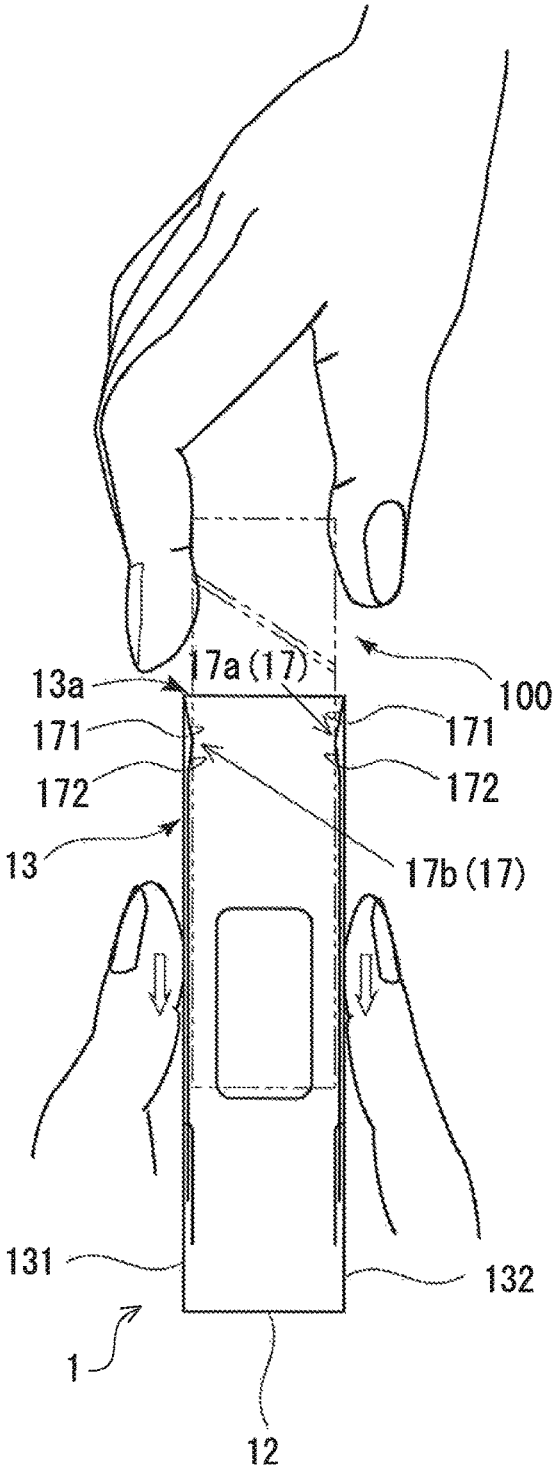
FIG. 10 is a view illustrating the storage case in a state where the package according to Embodiment 1 is in a process of being pulled from a storage part.

Now, operation when the package 100 is taken out of the storage part 14 of the storage case 1 will be described. In this case, as illustrated in FIG. 10, a user performs operation of pushing the operation parts 18 exposed through the windows 15 for operation part exposure of the storage case 1 downward, namely, toward the bottom surface wall 12 side. Herein, each of the operation parts 18 of the slip-out regulating parts 17 is disposed along the front wall 211 (rear wall 212) of the package 100 (package body 200), and therefore the operation part 18 is slid downward while the operation part 18 is pushed against the front wall 211 (rear wall 212), so that it is possible to easily pull the operation part 18 downward.

When operation of pushing the operation part 18 downward is performed, the whole of the sheet member 173 slides toward the bottom surface wall 12 side, and the locking part 172 of the slip-out regulating part 17 connected to the sheet member 173 is pulled downward. As a result, the angle famed by the pushed part 171 and the locking part 172 of the slip-out regulating part 17 is widened, and the slip-out regulating part 17 is shifted from the projecting posture to the flat posture. As a result, the effective cross-sectional area of the insertion opening 13*a* is widened, and slip-out of the package 100 from the storage part 14 is allowed. That is, locking of the package 100 by the locking part 172 of the slip-out regulating part 17 in the storage case 1 is released.

In the sheet member 173 of the storage case 1 according to this embodiment, the operation part 18 is formed as a tongue-shaped flap separated from other region by the three-side cut 19, and a position of the cut 19 is disposed near the edge of the window 15 for operation part exposure. Consequently, when the operation part 18 is pushed through the window 15 for operation part exposure, the operation part 18 is easily fitted to the front wall 211 (rear wall 212). As a result, there is an advantage that the operation part 18 can be smoothly pushed down, and the slip-out regulating part 17 can be easily shifted from the projecting posture to the flat posture.

Thereafter, the user can access the side walls 213 of the package 100 exposed through the windows 16 for package exposure formed in the storage case 1, slide the package 100 upward, and project the package 100 from the insertion opening 13*a*. Thereafter, for example, as illustrated in FIG. 10, the user directly can hold the package 100, and pull the package out of the storage case 1.

Furthermore, as illustrated in FIG. 9, the second tongue-shaped flap 21 formed by three-side cut 20 provided in the front surface wall 131 (rear surface wall 132) of the storage case 1 is folded on the storage part 14 side, so that window 15 for operation part exposure is foamed. Additionally, this second tongue-shaped flap 21 is inserted into the cut 19 in the sheet member 173 to be engaged with the cut 19. Consequently, it is possible to limit an upward sliding amount of the sheet member 173 within a predetermined range.

A case where the package 100 stored in the storage part 14 is tried to be pulled out without shifting the slip-out regulating parts 17 from the projecting posture to the flat posture is considered. In this case, the slip-out regulating parts 17 are each maintained in the projecting posture, and therefore the top wall 314 (bottom wall 214) of the package 100 is locked by the locking part 172 of the slip-out regulating parts 17. However, when the package 100 is slid upward by large force, there is a fear that the slip-out regulating parts 17 are each forcibly shifted from the projecting posture to the flat posture.

Figure 12A:
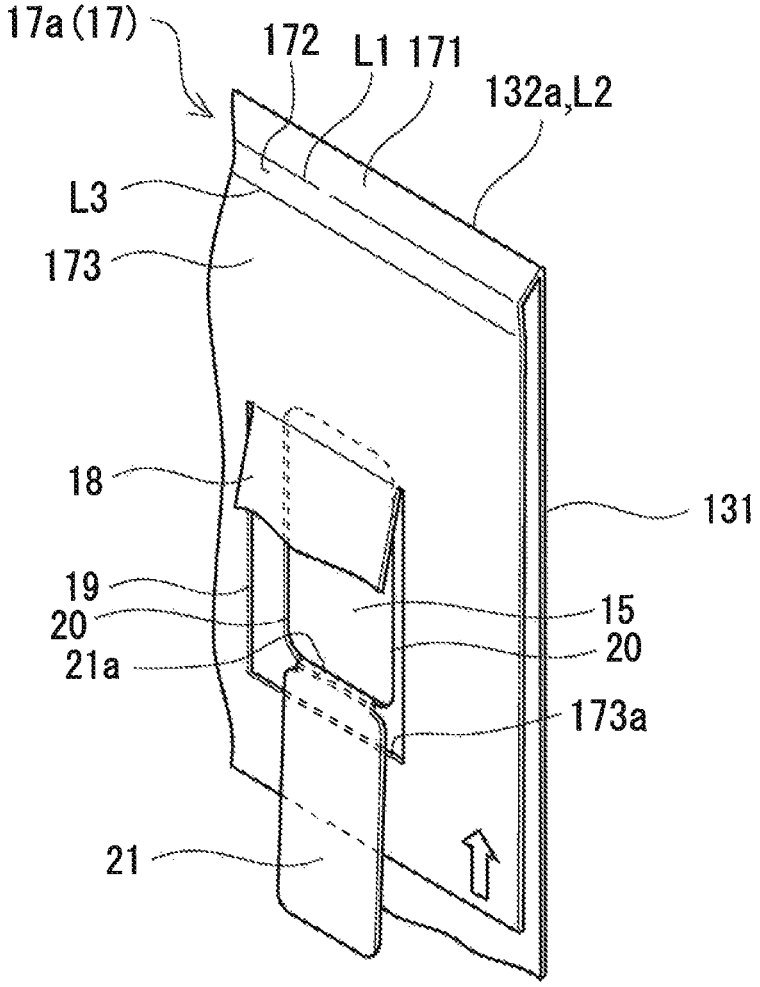
FIG. 12A is a partially enlarged view of the storage case according to Embodiment 1.

On the other hand, in the state illustrated in FIG. 9, a predetermined clearance (gap) is provided between a folded part 21*a* located on a base end side of the second tongue-shaped flap 21 and a lower edge 173*a* of the cut 19 in the sheet member 173. FIG. 12A is a view illustrating a relative relation between the folded part 21*a* of the second tongue-shaped flap 21 and the lower edge 173*a* of the cut 19 in the sheet member 173 in the state illustrated in FIG. 9.

Figure 12B:
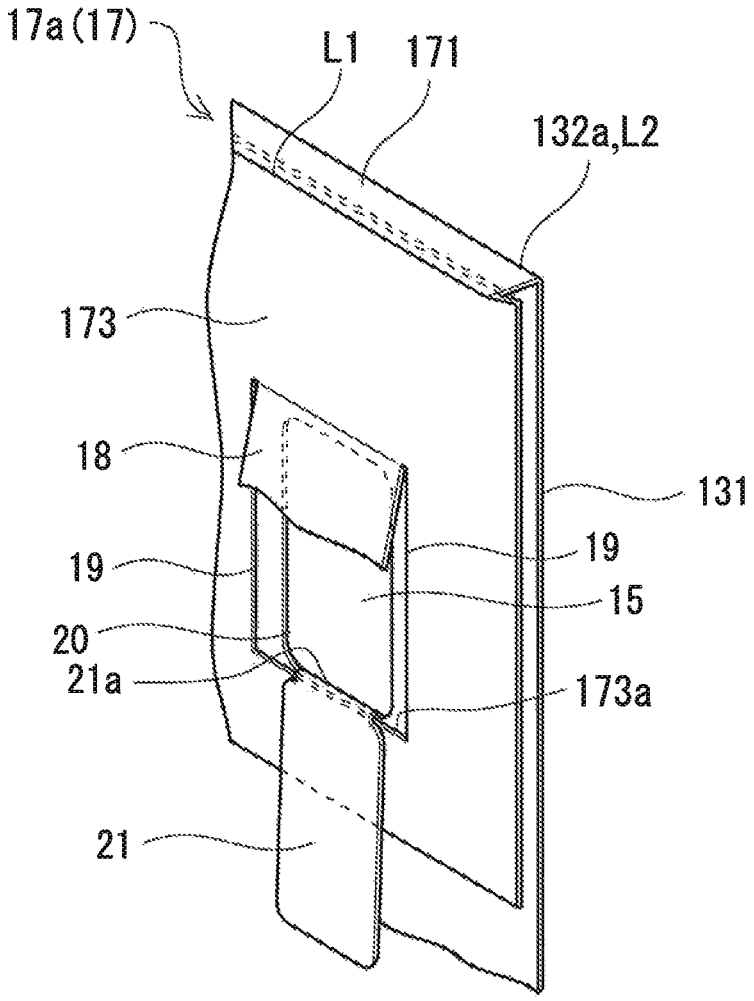
FIG. 12B is a partially enlarged view of the storage case according to Embodiment 1.

From the state illustrated in FIG. 12A, when the package 100 is slid upward through the window 16 for package exposure, the locking part 172 of the slip-out regulating part 17 is pushed upward by the top wall 314 (bottom wall 214) of the package 100, and the sheet member 173 slides upward. As a result, as illustrated in FIG. 12B, the clearance between the lower edge 173*a* of the cut 19 in the sheet member 173 and the folded part 21*a* of the second tongue-shaped flap 21 becomes zero. Then, the folded part 21*a* of the second tongue-shaped flap 21 comes into contact with the lower edge 173*a* of the cut 19 in the sheet member 173, and further upward sliding of the sheet member 173 is regulated. Consequently, it is possible to suppress forcible shift of the slip-out regulating part 17 from the projecting posture to the flat posture, and it is possible to suppress forcible pull-out of the package 100 from the storage part 14.

According to the storage case 1 in this embodiment, in a state where the package 100 is stored in the storage part 14, the sheet members 173 are in contact with the front wall 211 and the rear wall 212 of the package 100. Therefore, for example, when the package 100 tries to move upward inside the storage part 14 of the storage case 1 in a pocket of clothes or a bag, force of pushing the sheet member 173 upward acts on the sheet member 173 by frictional force between the front wall 211 (rear wall 212) on the package 100 side and the sheet member 173 on the storage case 1 side which are in the contact state. Thus, the force of pushing the sheet member 173 upward acts in such a direction that the posture of the slip-out regulating part 17 is maintained in the projecting posture, and therefore it is possible to more suitably suppress undesirable come-out of the package 100 from the storage part 14. Therefore, the longer the length of the sheet member 173 is, the larger the contact area between the outer surface of the package 100 and the sheet member 173 is, and the larger the frictional force between the both is, and therefore this is preferable from a viewpoint of suppression of undesirable come-out of the package 100 from the storage part 14.

As described above, according to the storage case 1 in this embodiment, the package 100 is housed in the storage part 14, so that it is possible to suppress unintended opening of the lid part 300. Accordingly, it is possible to suppress drop of a cigarette housed in the package 100 into a bag or a pocket, or falling of cut tobacco of a cigarette. Additionally, the storage case 1 can be easily assembled from a relatively inexpensive material such as plate paper and a resin material.

In the storage case 1 according to this embodiment, the windows 15 for operation part exposure are provided in a pair of facing surface in the rectangular tube wall body 13, and therefore, for example, while the operation part 18 of the first slip-out regulating part 17*a* are slid downward by a thumb of a hand holding the storage case 1, the operation part 18 of the second slip-out regulating part 17*b* can be slid downward by a middle finger or the like. Thus, according to this embodiment, it is possible to smoothly perform the pushing-down operation of the operation parts 18, namely, the shift of the postures of the slip-out regulating parts 17. Similarly, according to the storage case 1, the windows 16 for package exposure are provided in the pair of facing surfaces of the rectangular tube wall body 13, and therefore it is possible to smoothly perform push-up operation of the package 100.

<Modification>

Figure 13:
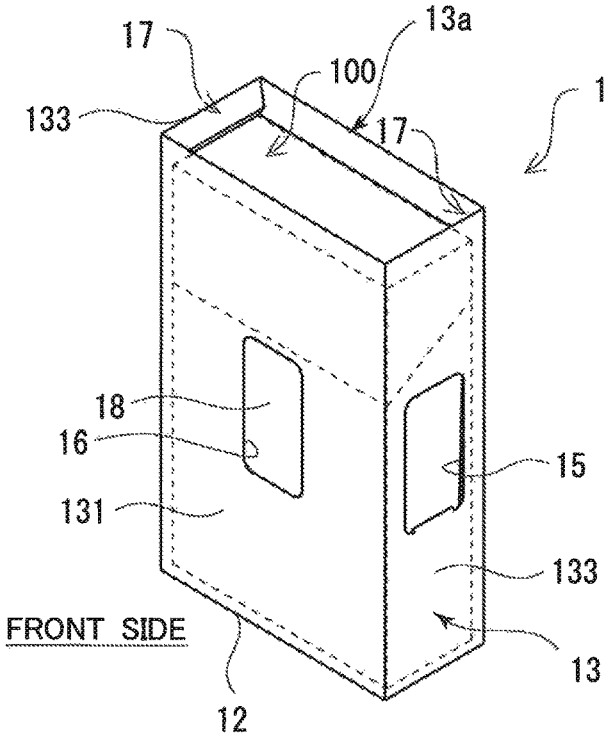
FIG. 13 is a view illustrating a storage case according to Modification 1.

However, the storage case 1 can adopt various modifications. For example, like a storage case 1 according to Modification 1 illustrated in FIG. 13, slip-out regulating parts 17 may be attached to a pair of short sides of an insertion opening 13*a* of a rectangular tube wall body 13, namely, an upper edge of a pair of side surface walls 133.

Figure 14:
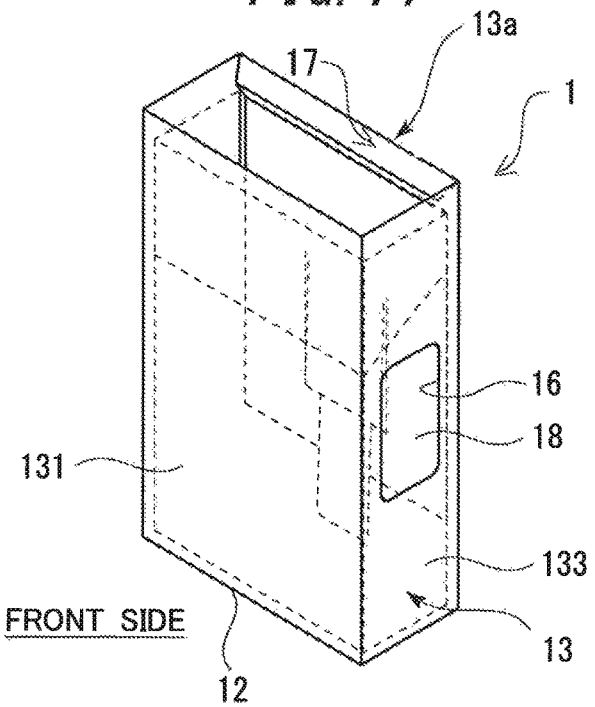
FIG. 14 is a view illustrating a storage case according to Modification 2.

Of course, in the storage case 1, a plurality of the slip-out regulating parts 17 do not need to be provided. Like a storage case 1 according to Modification 2 illustrated in FIG. 14, a single slip-out regulating part 17 may be provided in an insertion opening 13*a*. Additionally, the number of the windows 15 for operation part exposure to be installed and the position thereof, and the number of the windows 16 for package exposure to be installed and positions thereof are not particularly limited. For example, the windows 15 for operation part exposure and the windows 16 for package exposure may be formed in the bottom surface wall 12 of the storage case 1. For example, in a case where the window 15 for operation part exposure is provided in the bottom surface wall 12 of the storage case 1, the operation parts 18 are pushed upward while being slid, so that it is possible to push the package 100 up. In this case, a function of the window 16 for package exposure can be provided to the window 15 for operation part exposure, operation of pushing the package 100 up through an opening window different from the window 15 for operation part exposure becomes unnecessary, and the package 100 can be taken out of the storage part 14 of the storage case 1 by more simple operation.

A slip-out regulating part 17 may be attached to an upper edge of an arbitrary one surface (e.g., a front surface wall 131) of a rectangular tube wall body 13, a window 15 for operation part exposure may be provided in the above surface (e.g., front surface wall 131), and a window 16 for package exposure may be provided in a surface (e.g., a rear surface wall 132) facing the above surface (e.g., a front surface wall 131). Consequently, the package 100 stored in the storage part 14 can be taken out of the storage case 1 by one hand.

In the storage case 1 according to this embodiment, as the shape in which the slip-out regulating part 17 projects toward the inside of the rectangular tube wall body 13 in the projecting posture, a chevron or a triangle is adopted. However, the shape is not limited to these, and a circle or a quadrangle may be adopted.

When the slip-out regulating parts 17 of the storage case 1 are each in the projecting posture, the locking parts 172 are preferably famed such that an upper wall of the package 100 (the top wall 314 of the lid part 300 in the example illustrated in FIG. 1) stored in the storage part 14 of the storage case 1 faces the locking parts 172, and the locking parts 172 each become in a horizontal posture as illustrated in FIG. 1. Consequently, it is possible to suitably suppress pop-out of the package 100 from the storage part 14 of the storage case 1. Furthermore, when the slip-out regulating parts 17 of the storage case 1 are each in the projecting posture, as illustrated in FIG. 5, the pushed parts 171 are each preferably formed so as to become in a posture inclined to the bottom surface of the package 100 (the bottom wall 214 of the package body 200 in the example illustrated in FIG. 5). Consequently, the package 100 can be more easily inserted from the insertion opening 13*a* of the storage case 1.

While the preferred embodiments of the present invention are thus described, the storage case for a hinge-lidded box-type package according to the present invention can be implemented by combining the embodiments and the modifications as much as possible. Additionally, an object to be housed that is housed in the hinge-lidded box-type package stored in the storage case is not particularly limited. The storage case according to the present invention may be applied to other box-type hard package that does not include a hinge-lid. Examples of such a box-type hard package include a slide box type package including a substantially rectangular parallelepiped outer box with an open end, and a substantially rectangular parallelepiped inner box that is held so as to be slidable to the outer box, and houses an object to be housed, in which an outlet port of the object to be housed is exposed to the outside when the inner box is pulled out of the outer box.

REFERENCE SIGNS LIST

1 storage case
12 bottom surface wall
13 rectangular tube wall body
13*a* insertion opening
14 storage part
15 window for operation part exposure
16 window for package exposure
17 slip-out regulating part

171 pushed part
172 locking part
173 sheet member
100 package
200 package body
210 outer box
300 lid part

The invention claimed is:

1. A storage case for storing a hinge-lidded box-type package, the hinge-lidded box-type package including a package body that has an open end at an upper part, and is capable of housing an object to be housed therein, and a lid part that is rotatably coupled to an edge of the open end through a hinge, and opens and closes the open end, the storage case comprising:

a bottom surface wall;

a rectangular tube wall body that is erected from the bottom surface wall, and forms therein a storage part that stores the package; and an insertion opening that is formed at an upper edge of the rectangular tube wall body, and enables the package to be inserted, wherein a slip-out regulating part that regulates slip-out of the package from the storage part is attached to the insertion opening, wherein the slip-out regulating part regulates slip-out of the package from the storage part when the slip-out regulating part is in a projecting posture of projecting toward inside from the rectangular tube wall body such that an effective cross-sectional area of the insertion opening is narrowed, and the slip-out regulating part allows slip-out of the package from the storage part when the slip-out regulating part is in a flat posture along the rectangular tube wall body such that the effective cross-sectional area of the insertion opening is widened, wherein the slip-out regulating part includes a pushed part and a locking part connected to each other through a first folding line, and the pushed part is connected to an edge of the insertion opening through a second folding line, wherein the slip-out regulating part is shifted from the projecting posture to the flat posture when the pushed part is pushed by the package inserted from the insertion opening, and wherein the slip-out regulating part is shifted from the flat posture to the projecting posture, and the locking part locks the package when the package is stored in the storage part, and a pushed state of the pushed part is released.

2. The storage case for a hinge-lidded box-type package according to claim 1, wherein a window for package exposure that exposes an outer surface of the package stored in the storage part to outside is formed in the rectangular tube wall body or the bottom surface wall.

3. A storage case for storing a hinge-lidded box-type package, the hinge-lidded box-type package including a package body that has an open end at an upper part, and is capable of housing an object to be housed therein, and a lid part that is rotatably coupled to an edge of the open end through a hinge, and opens and closes the open end, the storage case comprising:

a bottom surface wall;

a rectangular tube wall body that is erected from the bottom surface wall, and forms therein a storage part that stores the package; and an insertion opening that is formed at an upper edge of the rectangular tube wall body, and enables the package to be inserted, wherein a slip-out regulating part that regulates slip-out of the package from the storage part is attached to the insertion opening, a sheet member that has a first end side connected to the slip-out regulating part and a second end side inserted into the storage part, and includes an operation part for operating the slip-out regulating part, wherein a window for operation part exposure for exposing the operation part of the sheet member to outside is formed in the rectangular tube wall body or the bottom surface wall, wherein the operation part is a tongue-shaped flap that is formed by a cut provided in the sheet member overlapped so as to close the window for operation part exposure from a side of the storage part, and wherein a position of the cut is disposed near an edge of the window for operation part exposure.

4. The storage case for a hinge-lidded box-type package according to claim 3, wherein the window for operation part exposure is formed by folding a second tongue-shaped flap on the side of the storage part, the second tongue-shaped flap being formed by a cut provided in the rectangular tube wall body, and a slide moving amount of the sheet member is limited within a predetermined range by engaging the second tongue-shaped flap folded on the side of the storage part with the cut provided in the sheet member that forms the operation part.

* * * * *